United States Patent [19]

Willis

[11] Patent Number: 4,624,636

[45] Date of Patent: Nov. 25, 1986

[54] TWO STAGE MATERIAL COOLER

[75] Inventor: Daniel A. Willis, Whitehall, Pa.

[73] Assignee: Fuller Company, Bethlehem, Pa.

[21] Appl. No.: 596,882

[22] Filed: Apr. 5, 1984

[51] Int. Cl.[4] ..... F27D 15/02

[52] U.S. Cl. ..... 432/78; 34/62; 34/168; 432/80; 432/96

[58] Field of Search ..... 34/62, 64, 65, 66, 67, 34/168, 169, 174; 432/78, 80, 82, 85, 96, 99, 100, 106

[56] References Cited

U.S. PATENT DOCUMENTS

| | | | |
|---|---|---|---|
| 1,895,284 | 1/1933 | Hay | 432/99 |
| 2,891,321 | 6/1959 | Habel | 34/174 |
| 3,261,106 | 7/1966 | Brockelmann et al. | 34/62 |
| 3,274,701 | 9/1966 | Niemitz | 34/168 |
| 3,284,072 | 11/1966 | Kramer | 34/79 |
| 3,539,164 | 11/1970 | Brachthauser | 34/174 |
| 3,667,133 | 6/1972 | Lincoln | 34/72 |
| 3,704,525 | 12/1972 | Devel | 34/164 |
| 3,705,620 | 12/1972 | Kayatz | 34/65 |
| 3,731,398 | 5/1973 | Niems | 34/169 |
| 3,824,068 | 7/1974 | Kobayashi et al. | 432/80 |
| 4,155,705 | 5/1979 | Nudelman et al. | 432/106 |
| 4,486,960 | 12/1984 | Maurice et al. | 34/64 |

*Primary Examiner*—Albert J. Makay
*Assistant Examiner*—David W. Westphal
*Attorney, Agent, or Firm*—Frank H. Thomson

[57] ABSTRACT

A two stage material cooling apparatus for cooling hot particulate material such as cement clinker discharged from a furnace such as the rotary kiln. The first stage includes a direct heat exchanger such as a reciprocating grate type heat exchanger or an attached tube cooler and serves primarily as a heat recuperator. This cooler acts on the principle of direct heat exchange between cooling gas and the hot material whereby the material is cooled and the gas is heated and returned to the kiln as preheated secondary air for combustion. The second stage cooler is a shaft type cooler with gas permeable sides so that cooling gas passes through the material generally perpendicular to the flow of material. The gas which is supplied to the second cooler can come from recirculated cooling gas or from ambient. The gas discharged from the second cooler can be supplied directly to the gas inlet of the first cooler recirculated to its inlet after passing through an air to air heat exchanger. In a preferred embodiment, the second cooler includes an arrangement whereby some of the cooling gas is supplied for passage through the material in the second cooler perpendicular to the flow of material and some of the gas is supplied so that it flows countercurrent to the flow of material in the second cooler for direct supply to the first cooler or to the furnace.

12 Claims, 8 Drawing Figures

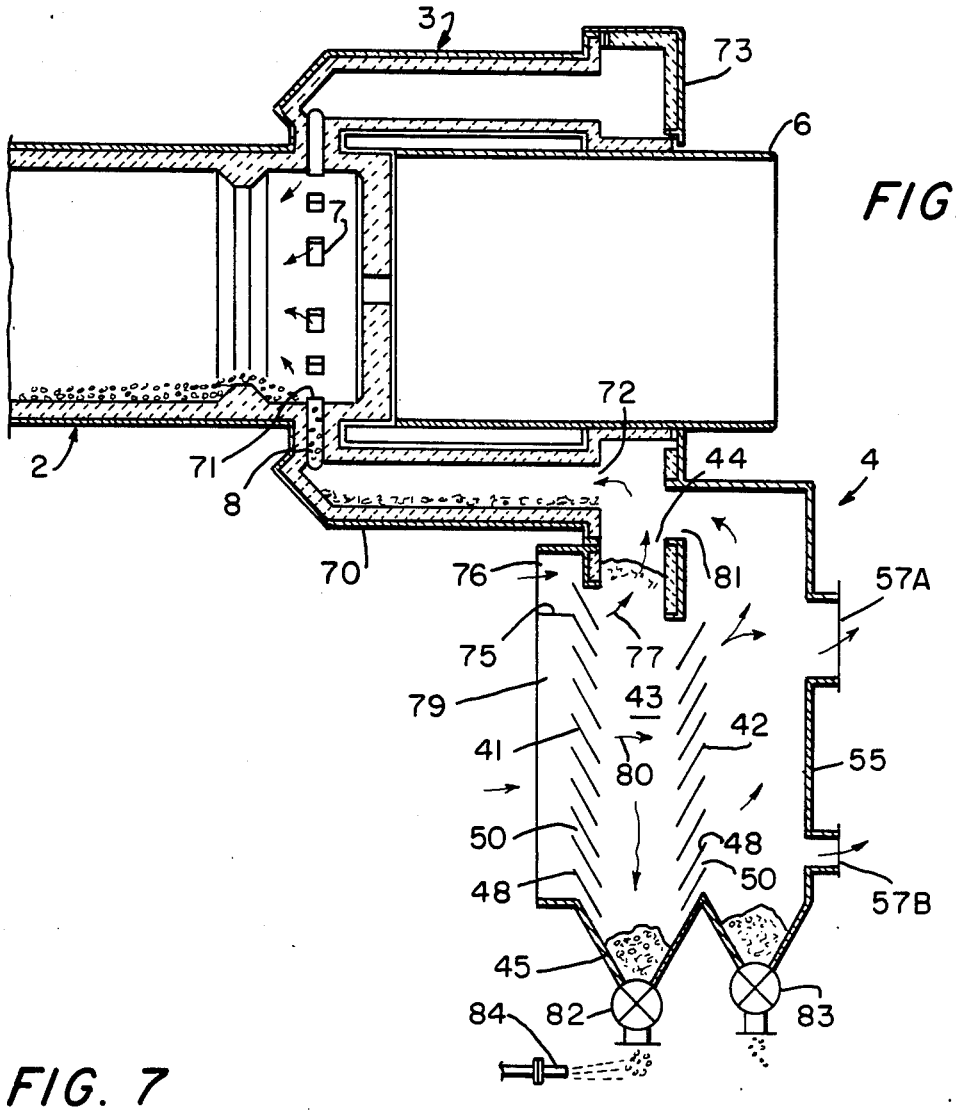
FIG. 2
FIG. 7
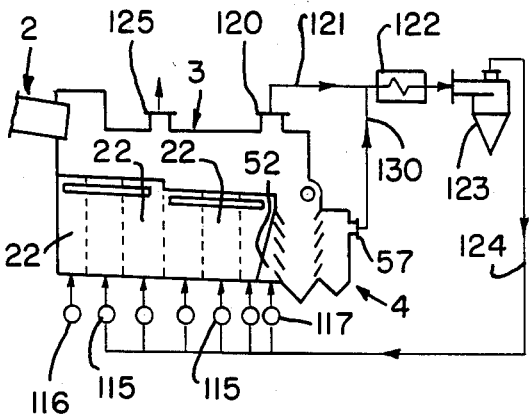
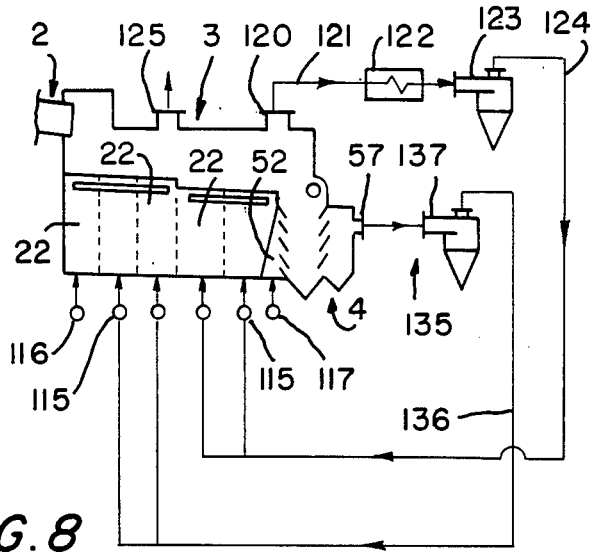
FIG. 8

TWO STAGE MATERIAL COOLER

BACKGROUND OF THE INVENTION

This invention relates to in general to gas solids heat exchangers and especially to coolers for hot particulate materials such as hot cement clinker which is discharged from a furnace such as a rotary kiln. More particularly, the invention relates to a two stage material cooler wherein the first stage serves to initially cool the material as it is discharged from the furnace and serves as a primary source of preheated gas to be supplied to the kiln as secondary air for combustion and the second cooler consists of a shaft type cooler for finally cooling the material.

Prior to the present invention it was generally known to cool particulate material being discharged from a furnace such as a kiln in various apparatus such as an attached tube cooler or a reciprocating grate type cooler both well known in the art. Each of these primary coolers has its advantages and disadvantages. It is also known prior to the present invention to utilize a two stage cooling apparatus wherein a reciprocating grate type cooler is utilized to achieve a rapid quench cooling of the material discharged from the furnace and a secondary cooler is utilized to achieve final cooling of the material. Such an apparatus is shown for example in U.S. Pat. No. 3,705,620 wherein a primary direct heat exchanger is followed by a secondary indirect heat exchanger. An indirect heat exchanger is inherently less efficient than a direct heat exchanger. Such a device is also shown in U.S. Pat. No. 3,824,068 wherein a primary recuperator or first stage heat exchanger is followed by a secondary shaft type cooler wherein product cooling takes place by direct heat exchange between a cooling gas and the material. In each of these prior apparatus, the gas which is collected from the outlet of the second cooling stage can be supplied to the gas inlet of the first cooling stage for use as cooling gas therein.

It is also known prior to the present invention to have a gas to particulate material heat exchanger wherein the material moves generally vertically in a material shaft and the gas passes through the material generally perpendicular thereto through gas permeable sidewalls of the material shaft. Such an apparatus is illustrated in U.S. Pat. No. 3,284,072 as a preheater for solid particulate material to be supplied to a kiln.

The use of a perpendicular gas flow path has the advantage that the cooling gas only passes through a shallow depth of material thereby reducing the pressure drop across the heat exchanger and consequent reduction in energy consumption. While the shallow depth of material means less gas-solids contact at any given point, the height of the material shaft results in the material being exposed to cooling gas for a long period of time to achieve effective cooling. This compares with counterflow shaft type heat exchangers wherein the material flows generally vertically downward through a shaft and the gas moves generally vertically upward through material in the shaft countercurrent to the flow of material. This type of cooler often has a deep bed of material with the resultant advantage of intimate contact between the particulate material and gas to achieve complete heat exchange. The deep bed of material results in the disadvantage of high pressure drop and consequent increase in energy consumption due to the need for a high pressure fan.

Also prior to the present invention as illustrating in U.S. Pat. No. 3,704,525, in an effort to reduce or eliminate the need for a high efficiency dust collector in conjunction with a grate type cooler, it was known to recirculate cooling gas back to the inlet for cooling gas after it had passed through an air to air heat exchanger or other gas cooler thereby eliminating a vent to atmosphere and the need for a high efficiency dust collector.

According to the present invention, a material cooler has been provided which combines the advantages of the various known types of coolers for particulate material such as cement clinker while eliminating some of the disadvantages of such coolers. For example, the present invention can be utilized to achieve a rapid initial cooling of the material discharged from the kiln, i.e. quench cooling of the material. This is particularly advantageous when cooling cement clinker. The present invention combines the advantage of a shaft cooler with the advantage of a crossflow cooler by utilizing a secondary cooler which has cooling gas flow both countercurrent to the flow of material and across to the flow of material. The invention also combines the advantage of a recirculation to eliminate or substantially eliminate the need for high efficiency dust collection equipment for removing fine material carried over with the cooling gas.

The two stage material cooler of the present invention offers further advantages over existing designs. These include low power consumption due to a transfer of a large portion of the cooling process to the secondary cooler that requires only small amounts of power for its material feeders. A second advantage is reduced power requirements for the cooling air fans for the panel bed cooler since the cooling gas is flowing through a relatively thin, vertical bed or panel of material. A further advantage is reduced capital costs for the equipment and elimination or reduction of dust collection equipment requirements.

SUMMARY

It is a principal object of this invention to provide a cooling apparatus for hot particulate material which retains the advantage of rapid initial cooling of the product being discharged from the furnace and return of preheated secondary combustion air to the furnace while adding the advantage of low power consumption.

Another object of this invention is to provide a clinker cooling apparatus that provides high secondary combustion air temperatures while consuming low energy through the use of a panel bed clinker cooler that combines both counterflow and crossflow heat transfer concepts.

Briefly stated, the foregoing and other objects of this invention will be carried out by providing apparatus for cooling particulate material such as cement clinker discharged from a furnace such as a rotary kiln comprising a first cooler including a housing having an inlet for material to be cooled flow connected to the outlet of the furnace for receiving hot particulate material, an outlet, porous grate means dividing the housing into an upper material chamber and a lower plenum chamber for supporting in the upper material chamber a bed of material to be cooled and for moving material from the inlet of the housing to the outlet and means for supplying cooling gas to the lower plenum chamber of the first cooler for passage upwardly through the porous grate means and the bed of material whereby material is at least partially cooled and the gas is heated and at least some of the thus heated gas is supplied to the furnace; a second cooler having substantially solid end walls and first and second gas permeable side walls defining a material shaft having an upper inlet flow connected to the outlet of the first cooler and a lower outlet for cooled particulate material whereby the material to be cooled falls through the material shaft by gravity; said first gas permeable side wall defining a cooling gas inlet of the second cooler and the second gas permeable side wall defining a gas outlet of the second cooler; means for supplying cooling gas to the gas inlet of the second cooler, through the material in the material shaft and into the gas outlet of the second cooler for cooling material in the material shaft by direct heat exchange; and first conduit means flow connecting the gas outlet of the second cooler to the means for supplying cooling gas to the lower plenum chamber of the first cooler.

The apparatus of the present invention beneficially modifies a conventional attached tube or grate cooler by combining the grate or attached tube cooler with a panel bed cooler that utilizes both counterflow and crossflow heat transfer. Secondary combustion air required for combustion in the furnace is induced to flow through the multi cylinder attached tube cooler or the grate cooler after passing through the upper portion of the panel bed cooler in which the clinker transfers heat to this cooling air in a countercurrent mode of heat exchange. The partially cooled material is then transferred to the inlet of the panel bed secondary cooler. As the clinker to be cooled moves downwardly through the panel bed due to the action of gravity, additional cooling is accomplished in a cross flow heat exchange between the clinker and the cooling air. The cool clinker is discharged through multiple feeders in the bottom of the panel bed which insures a mass type of clinker flow, i.e. first in--first out. Gases which are not required for use as secondary air for combustion in the furnace are recirculated to the panel bed cooler in one embodiment or to the primary cooler in another embodiment thereby achieving a ventless cooler which can eliminate the need for a high efficiency dust collector.

BRIEF DESCRIPTION OF THE DRAWINGS

The invention will be described in connection with the annexed drawings wherein

FIG. 2 is a sectional view of a second embodiment of the present invention;

FIG. 7 is a diagramatic view of a further embodiment of this invention illustrating another gas and material flow scheme; and FIG. 8 is a diagramatic view of an embodiment similar to that shown in FIG. 7 illustrating a still further gas and material flow scheme of the present invention.

DESCRIPTION OF THE PREFERRED EMBODIMENTS

Figure 1:
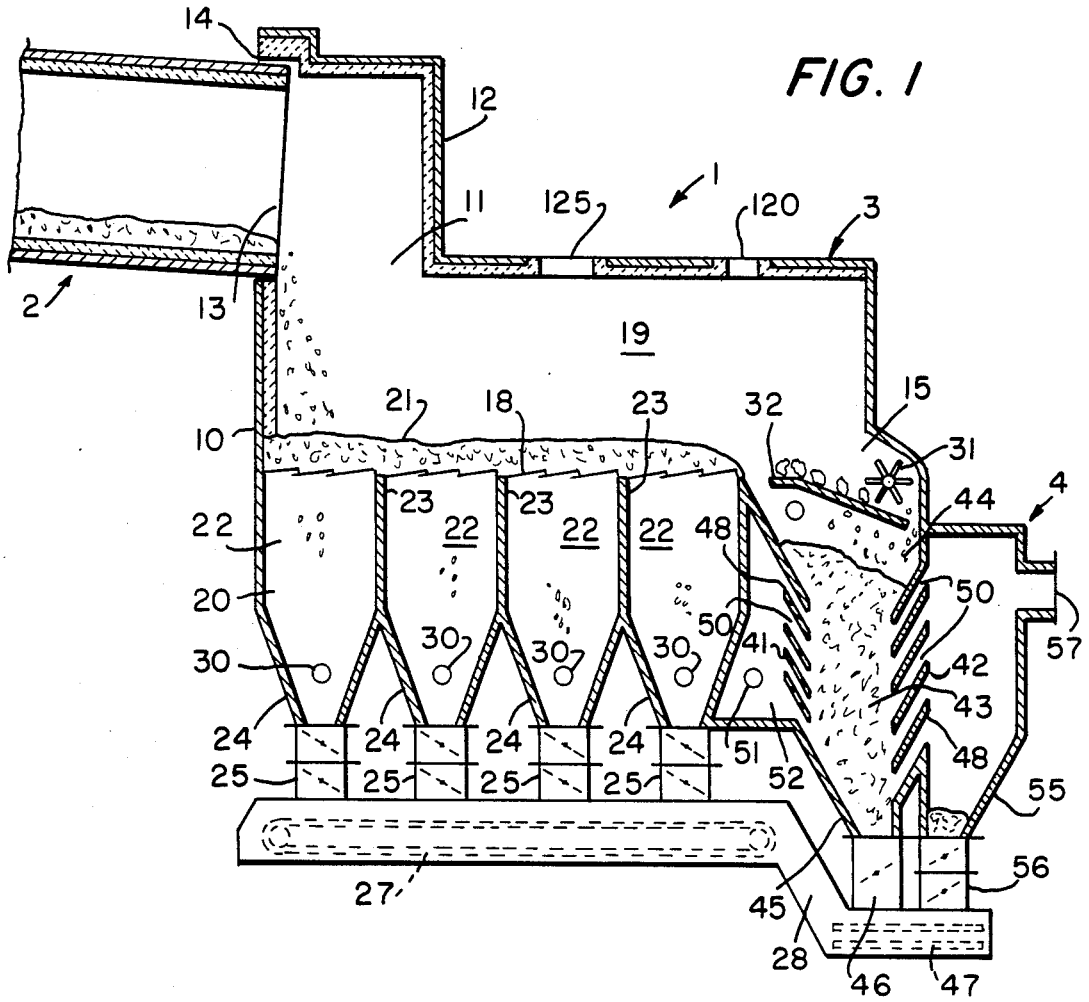
FIG. 1 is a sectional view of one embodiment of the present invention.

Referring initially to FIG. 1, the two stage cooler of the present invention is generally indicated by the numeral 1 and is flow connected to a furnace such as a rotary kiln generally indicated at 2. The cooler 1 includes a first cooling apparatus generally indicated at 3 and a second cooling apparatus generally indicated at 4.

In FIG. 1, the first cooler 3 takes the form of a reciprocating grate cooler and in FIG. 2 the first cooler takes the form of an attach tube cooler. Both types of coolers are well known in the art and will not be described in detail. It is to be understood that the present invention is applicable to both types of coolers.

Referring to FIG. 1, the first cooler 3 includes a housing 10 having an inlet 11 defined by a conduit means 12 flow connected to the outlet 13 of the furnace or kiln 2 in a manner generally known in the art. A suitable seal 14 may be provided between the end of the kiln 2 and the inlet conduit 12 of the cooler 3. The housing 10 also includes an outlet 15 for at least partially cooled material. A porous grate means generally indicated at 18 is mounted in the housing 10 and divides the housing into an upper material chamber 19 and a lower plenum chamber 20. The grate means 18 includes a plurality of rows of grates with fixed rows alternating with rows that are reciprocated by means well known in the art. The grate system 18 supports a bed 21 of material to be cooled and the reciprocating grates move the material from the inlet 11 to the outlet 15.

The lower plenum chamber 20 is preferrably divided into a plurality of compartments 22 by spaced apart walls 23. These compartments 22 are tapered near their bottom to form hoppers 24 which are closed by suitable valve means such as double tipping valves 25, also known in the art. The gas permeable grates which make up the porous grate means 18 will allow some material to fall therethrough into the compartments 22 and the valves 25 allow this material to fall onto a suitable conveyor such as a drag chain 27 without allowing gas to escape therethrough.

Each of the compartments 22 includes an inlet 30 for supplying cooling gas to the lower plenum chamber of the first cooler 3 from a source such as fans 115, 116 in FIGS. 7 and 8 for passage upwardly through the gas permeable grates system 18 and the bed 21 of material for cooling the material. As the material is cooled by the gas, the cooling gas is heated to a high temperature and returned through cooler inlet conduit 12 to the kiln 2 and serves as secondary air for combustion. The flow of cooling air upwardly through the bed 21 of material not only serves to recuperate heat from the hot material and return it to the furnace for energy conservation, but also serves to quench cool the material.

The first cooler of FIG. 1 also includes a clinker breaker 31 of a type known in the art and a grizzly or screen 32 which cooperates with the breaker 31 to insure that large pieces of material are broken up, and thrown upstream into the first cooler 3 so that they are at least partially cooled in the first cooler stage 3. The screen 32 allows smaller material to fall therethrough and be supplied to the second cooler 4.

Figure 3:
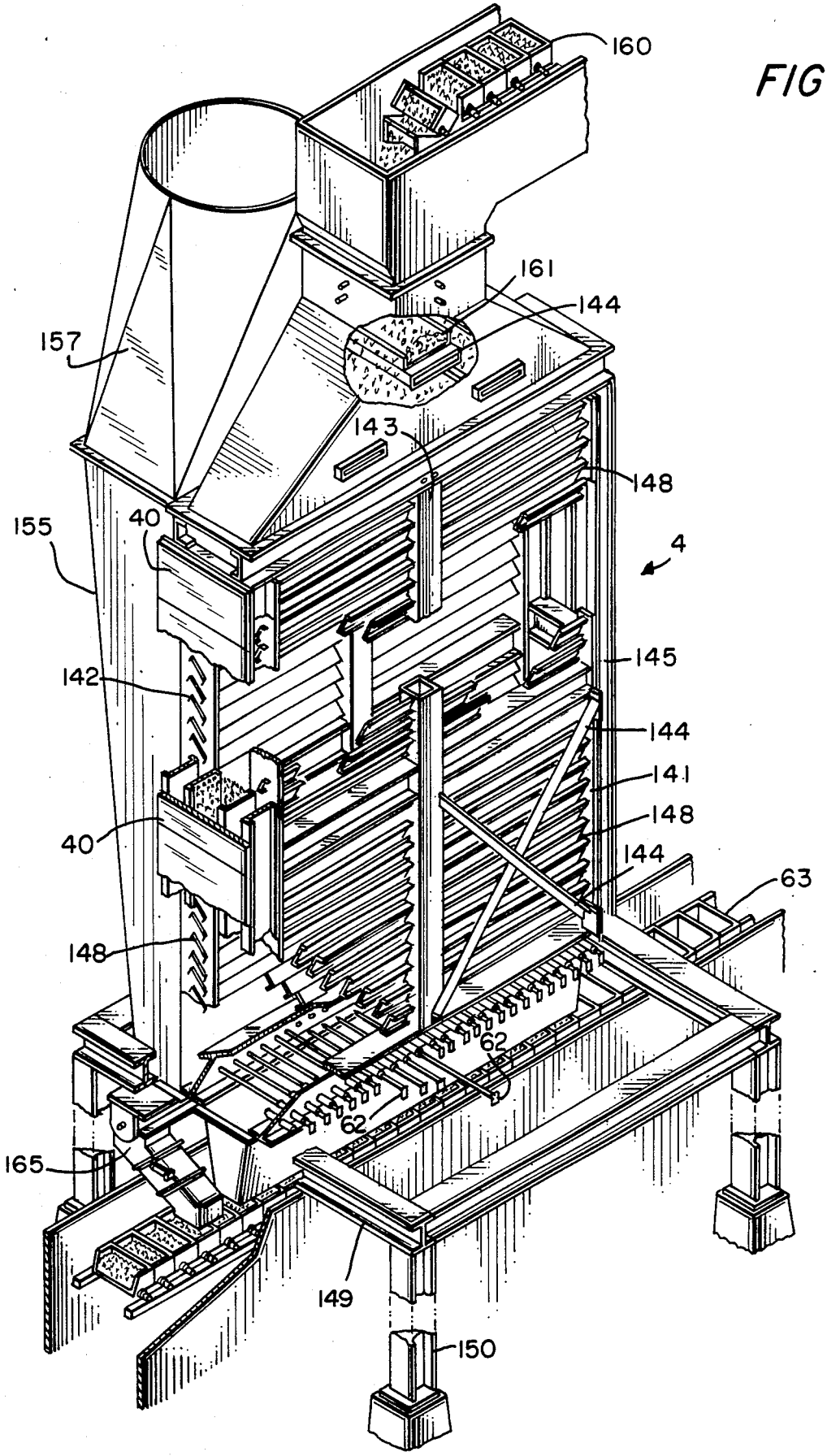
FIG. 3 is a perspective view of a second stage cooler according to the present invention.

The second cooler is diagramatically illustrated in FIGS. 1 and 2 and shown in greater detail in FIG. 3. This cooler includes substantially solid end walls 40 (shown in FIG. 3) and first and second gas permeable side walls 41 and 42 defining a material shaft or panel 43 having an upper inlet 44 flow connected to the outlet 15 of the first cooler 3 and a lower outlet 45 for cooled particulate material. A valve means 46 seals outlet 45 and controls the flow of material out of shaft 43 onto a conveyor 47 which serves as a cooled product conveyor. Conveyor 27 is flow connected to conveyor 47 by a chute 28.

The sides 41 and 42 are formed from a plurality of spaced apart beam members or slats 48 mounted at an angle to the horizontal to define a plurality of generally horizontal gas passageways 50 spaced apart along the height of the material shaft. The beams are mounted at an angle to horizontal sufficiently large to prevent material which moves by gravity from the upper inlet 44 to the lower outlet 45 from spilling out of the material shaft and sufficiently small to allow gas to pass therethrough between the individual beam members 48. As can be seen from FIGS. 1 and 2, the sidewalls of the second cooler form a venetian blind type configuration. The slats are set at an angle that is steep enough so that at the natural angle of repose of the material to be cooled, the material within the shaft 43 will not flow out the space 50 between the slats 48 and spill out of the shaft 43. Of course, the angle cannot be so steep as to close or inhibit gas flow through the walls.

Figure 5:
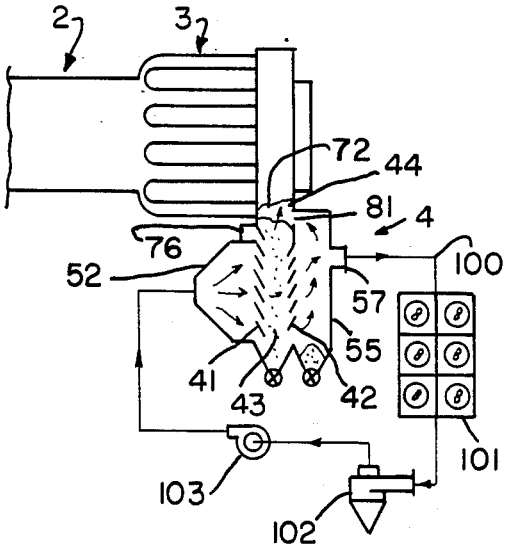
FIG. 5 is a diagramatic view of one form of the invention illustrating a material and gas flow scheme according to the present invention.
Figure 6:
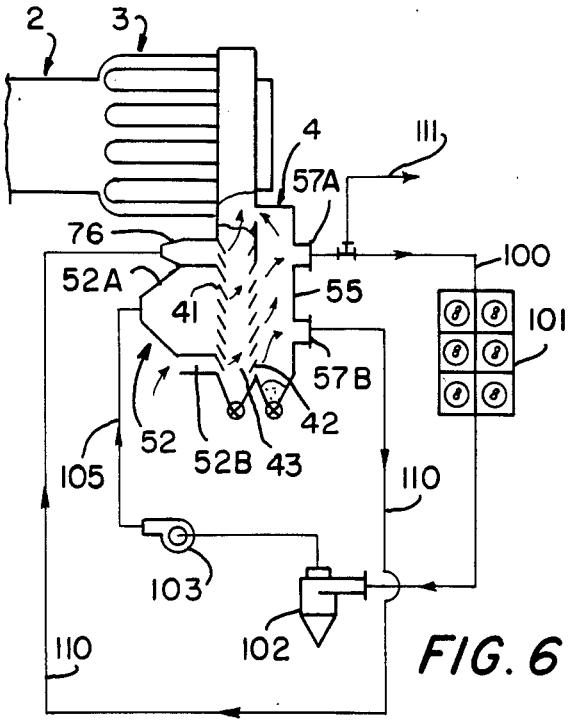
FIG. 6 is a diagramatic view of a form of the invention similar to that shown in FIG. 5 but illustrating a different material and gas flow scheme.

The first wall 41 defines a cooling gas inlet which is connected to a source of cooling gas such as fan 117 in FIGS. 7 and 8 or fan 103 in FIGS. 5 and 6. In FIG. 1 this is illustrated by the gas inlet 51 connected to a compartment 52 adjacent to the wall 41. As diagramatically illustrated in FIG. 2, the wall 41 maybe open to atmosphere to serve as the source of cooling gas.

The second gas permeable side wall 42 defines a gas outlet of the second cooler 4. As illustrated in FIG. 1, this outlet may be connected directly to a plenum chamber 55 which serves as a knockout box for particulate material and is sealed by double tipping valves 56 and has a gas outlet 57. The outlet wall 42 and chamber 55 may be connected to the inlet of a suitable fan means to subject the material shaft to a negative pressure to draw cooling air through wall 41, material shaft 43 and outlet wall 42, or the inlet wall 41 can be connected to the outlet of a fan to force cooling gas through inlet wall 41 for direct heat exchange with material to be cooled in material chamber 43 and outlet wall 42.

The depth of material within shaft 43 between walls 41 and 42 is thin compared with height of the material shaft. This insures that most of the cooling gas flows directly across the material, perpendicular to the flow path of material from inlet 44 to outlet 45. This thin bed means that the gas pressure drop across the panel bed 43 is small compared to the pressure drop experienced with ordinary shaft coolers. This means a lower horsepower motor is needed to force cooling gas through the material with resultant reduction in operating costs.

In FIG. 2, the first or primary cooler 3 is indicated as an attached tube cooler which, as well known in the art includes a plurality of circumferentially spaced apart tubes 70 mounted at the discharge end of the kiln for rotation with the kiln. A tunnel 6 serves to support the ends of the cooler tubes 70. Each tube 70 has an inlet 71 flow connected to the kiln 2 through a plurality of kiln opening 7 connected to passage 8 for receiving material therefrom. Each of the cooler tubes 70 also include a material outlet 72 which is flow connected to a manifold means 73 which forms the outlet of the first cooler apparatus in this embodiment. As is conventional in this type of cooler, material is discharged from the kiln through openings 7 and passages 8 into tubes 70. As the kiln and attached tubes are rotated around the kiln axis material in the tubes 70 tumble from their inlet to the outlet 72. Cooling gas is supplied to outlet 72 and flows up tubes 70 generally countercurrent to material flow to passage 8 and openings 7. The gas cools the material and is heated by the hot material to serve as secondary air for combustion in the kiln.

In FIG. 2, the outlet manifold 73 of first cooler 3 is flow connected to the inlet 44 of the second cooler 4. In the embodiment illustrated in FIG. 2, the inlet side of the secondary cooler 4 is divided into two parts by a partition 75. This partition serves to divide the cooler 4 into a combined cross current and countercurrent flow cooler. Gas which enters the first wall 41 through upper compartment 76 will fow through wall 41 and upwardly through material chamber 43 as shown by the arrows 77 countercurrent to the flow of material through channel 43 and directly into the material outlet, gas inlet 72 of the cooler tubes 70. This is because the depth of material above partition 75 is less than the width of shaft 43 so that the easiest gas flow path is countercurrent to material flow. The lower section 79 of the inlet of the second cooler 4 is positioned so that gas flows cross current to the material in the shaft 43 as illustrated by the arrows 80 because material depth above section 79 creates too high a pressure. This gas flow proceeds in direct heat exchange with the material in shaft 43 and flows through outlet wall 42 into chamber 55 either through a passage 81 into the material outlet gas inlet 72 of cooler tubes 70 or proceeds through outlets 57A or 57B of the chamber 55. The shaft 43 and the chamber 55 are closed in this embodiment by rotary feeders 82 and 83. If desired, a final blast of cooling air maybe forced upon the material by a suitable nozzle 84.

One form of a secondary cooler is illustrated in grater detail in FIG. 3. In this embodiment, the sidewalls 141 and 142 are formed of a plurality of horizontally extending vertically spaced apart channel beams 148. These beams are mounted at an angle to form the space 50 therebetween to define the gas permeable walls 141 and 142. The sidewalls 141 and 142 are spaced apart a small distance compared to the distance between end walls 40 to define a relatively thin panel or material shaft. Box beams 143 and cross bracing 144 as well as end beams 145 serve to support the beams 148. The entire second cooler 4 may be supported on suitable structural members 149 and 150.

In FIG. 3, the outlet 142 is connected to a plenum 155 which has an outlet 157 for removing spent cooling air from the cooler 4. A suitable dust return conduit 165 is positioned at the bottom of the plenum 155.

In FIG. 3, material is supplied to the inlet 144 by means of a material conveyor 160 rather than being close coupled to the outlet of the primary cooler. Also in this embodiment, a distributor 161 is mounted in the inlet 144 for distributing material to be cooled throughout the upper part of the material shaft.

The cooler 4 includes means mounted at the lower outlet for controlling the flow of material through the material shaft. In FIGS. 1 and 2, this can take the form of the valve 46 or the rotary feeder 82. In FIG. 3, this takes the form of a plurality of transverse rods 62 positioned in the bottom of the material shaft 43. These rods can be moved in and out of the material shaft to control the rate at which material falls through the cooler. Usually, these would be set in positins prior to material being supplied to the material shaft. The control means of FIG. 3 also includes a conveyor 63 which is similar to that shown at 27 in FIG. 1 and may take the form of a drag chain conveyor. The speed of the conveyor 63 will, to some degree, control the rate of withdrawal of material from shaft 43. The dust return conduit 165 is suitably connected to conveyor 63 and compares with valves 56 in FIG. 1 and rotary feeder 83 in FIG. 2.

Referring now to FIGS. 5 to 8, the various embodiments and application of the present invention are diagramatically illustrated. In FIGS. 5 and 6 and attached tube cooler of the type illustrated in FIG. 2 is utilized wherein FIGS. 7 and 8 a grate type cooler as illustrated in FIG. 1 is utilized. It is to be understood that either primary cooler can be used in either of the flow schemes of FIGS. 5 and 6. Thus, the attached tube cooler of FIGS. 5 or 6 could be replaced by a grate type cooler such as shown in FIG. 1.

Referring first to FIG. 5, material discharged from the primary or first cooler 3 is supplied to the second cooler 4 and specifically to the inlet 44 of the material shaft 43. The first wall 41 is flow connected to a source of cooling gas such as through plenum chamber 52. The outlet 57 of chamber 55 is connected by a conduit 100 through an air-to-air heat exchanger 101 which serves to cool gas within the conduit 100, then to a cyclone type separator 102 to separate a substantial portion of any particulate material which may be carried out of cooler 4 through outlet sidewall 42 and contained in the gas stream. A fan 103 serves as the source of pressurized gas and supplies pressurized gas to the plenum 52 and draws a vacuum or chamber 55 whereby the cooling gas passes through wall 41 for direct heat exchange with the panel material in the material shaft 43, cooling the material therein, through outlet wall 42 and into the chamber 55. Some of the gas passes from chamber 55 through passage 81 to the gas inlet/material outlet 72 of the primary cooler 3. The upper portion of shaft 43 is open to atmosphere through chamber 76 to permit ambient air to be drawn through upper chamber 76 by the draft in the kiln 2 acting through primary cooler 3 to give material in material shaft 43 an initial charge of cool air. This cooling gas flows countercurrent to the flow of material being cooled. The system of FIG. 5 defines a substantially closed system with an absence of vent to atmosphere so that a high efficiency dust collection system is not required. As material falls through shaft 43, it is continuously exposed to cooling air flowing across the width of the material generally perpendicular thereto. The material shaft is dimensioned to form a thin bed of material so that a low pressure fan may be used at 103.

Referring to FIG. 6, a modified system is used wherein the plenum chamber 52 is divided into sections 52A and 52B with the section 52B exposed to atmosphere to serve as a final cooling stage for material being discharged through the outlet 45. The chamber 52A is connected by conduit 105 to fan 103, to the air to air heat exchanger 101 and conduit 100 as in FIG. 5. In this arrangement outlet 57A is connected to a second conduit means 110 for supplying gas directly to chamber 76. Also in the embodiment of FIG. 6, a branch conduit 111 connected to conduit 100 may be connected to some other use point such as a dryer for raw material or coal to be used as fuel in the furnace. Thus, in FIG. 6, the inlet side 41 of the material shaft is connected to a pair of conduit means 105 and 110 through chambers 76 and 52A, respectively, each flow connected to the outlet side 42 at 57A and 57B for recirculating to the inlet side at least some of the gas which hs passed through the material shaft. At least one portion 52B is open to atmosphere to permit ambient air to be drawn into the secondary cooler. As in the embodiment of FIG. 5, the flow scheme of FIG. 6 provides for both countercurrent cooling gas flow from plenum 76 upwardly through shaft 43 and cross current flow from plenum 52 across material shaft 43.

Referring to FIG. 7, the primary cooler 3 is illustrated as a grate type cooler and includes a plurality of fans 115 and 116. The first compartment 22 of this cooler has a fan 116 connected thereto for supplying ambient air to that compartment so that material immediately discharged from the kiln is subjected to ambient air to quench cool the material. The remaining compartments 22 have undergrate fans 115 connected thereto. A fan 117 is connected to compartment 52 and inlet 51. In this embodiment, some of the gas which is vented from the cooler 3 through an outlet 120 is conducted by a conduit 121, through a heat exchanger changer 122 to cool such gas and a cyclone separator 123 to remove dust carryover to conduit 124 and then to fans 115 to define a second conduit means recirculate cooling gas which has previously passed through the bed 21 of material in cooler 3. At least some of the gas which has passed through the material in cooler 3 and is heated and conducted to the kiln to serve as secondary combustion air. When the cooler of the present invention is used in connection with a flash calciner system for producing cement clinker wherein raw material is calcined in a stationary, separately fired vessel and the clinkering phase takes place in the kiln, a second vent point 125 is provided to conduct some of the gas heated by the hot material to that separate calciner vessel.

In FIG. 7, the second cooler 4 is vented through outlet 57 and second conduit means 130 to the conduit 121 for passage through gas cooler 122 and collector 123 to be recirculated to the fans 115 and then to the gas inlet of the first cooler 3 and to fan 117 and then to the gas inlet of the second cooler 4.

In the embodiment of FIG. 8, the system of FIG. 7 has been modified slightly to provide a separate loop or second conduit means 135 for gas which is passed from the secondary cooler 4 and returning that gas to the fans 115 and the gas inlet of the first cooler 3. This circuit 135 will include conduits 136 and cyclone separator 137. Gas which is supplied from the first cooler 3 through conduit 121 is supplied as one of the sources of gas for the primary cooler 3. In this embodiment, the source of cooling gas for the second cooler is ambient air through fan 117 and gas which has passed through second cooler 4 is also used as a source of gas for the first cooling apparatus 3.

Figure 4:
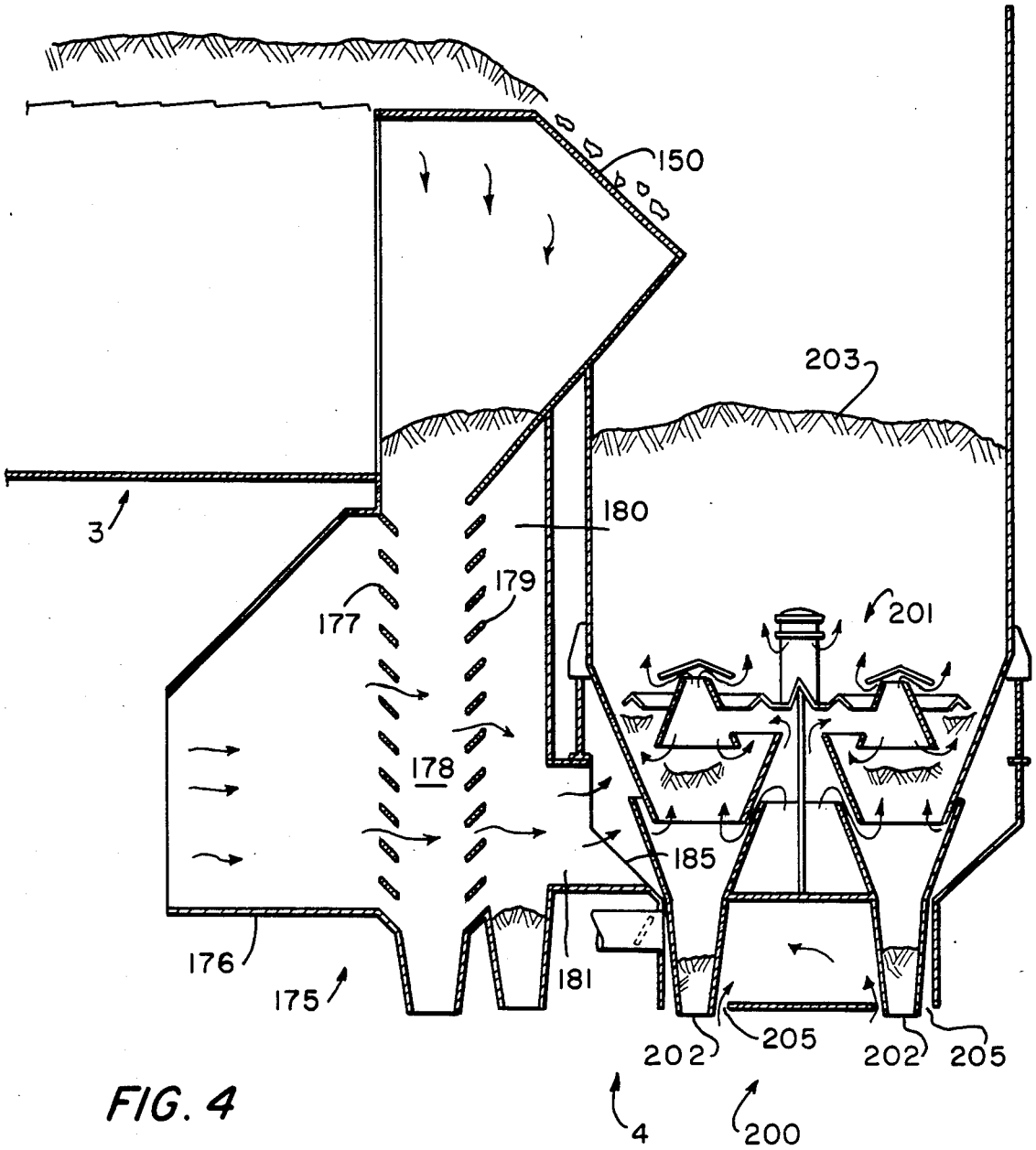
FIG. 4 is a sectional view of a further embodiment of the present invention.

There are applications where it is desirable to separate the discharge from the primary cooler 1 into a coarse fraction and a fine fraction and cool those two fractions separately. Such an arrangement is shown in FIG. 4 wherein the secondary cooler has been divided into a cooler for fines generally indicated at 175 and a cooler for coarse material generally indicated at 200. The cooler 175 is substantially the same as the cooler shown in FIGS. 1, 2 and 3. The cooler 200 is a shaft cooler of the type shown in U.S. Pat. No. 3,731,398 wherein cooling as flows countercurrent to material flow.

A screen means 150 is positioned at the outlet of primary cooler 3 and the coarse material which passes over screen 150 is supplied to the shaft cooler 200 and the fine material which passes through screen 150 is supplied to the cooler 175. In this embodiment, the cooling gas which is used in the cooler 4 is supplied to the cooler 175 through inlet 176 which is flow connected to inlets sidewall 177. The cooling air passes through the panel 178 of fine material and outlet sidewall 179 to a plenum 180. The plenum 180 is connected by a conduit 181 to the gas inlet plenum 185 of the cooler 200. A series of cones and hoppers generally indicated at 201 similar to that shown in U.S. Pat. No. 3,731,398 are utilized to direct material flow downwardly through the cooler to outlets 202 and cooling gas up through the bed 203 of material. Additional ambient cooling air can be drawn through gaps 205. The cooling gas which has passed through the hopper arrangement 201 and the deep bed 203 of material can be withdrawn from cooler 200 in a manner similar to FIGS. 5 to 8.

From the foregoing it should be apparent that the objects of this invention have been carried out. A cooler has been provided which combines the advantages of a primary cooler such as a grate cooler with the advantages of a shaft type cooler to achieve rapid initial cooling of the material while supplying preheated combustion air to the furnace. This is accomplished through either an attached tube cooler or a grate cooler. The cooler in the present invention also includes a secondary cooler which serves to finally cool the material at low power consumption. The combined cooler serves to eliminate a venting to a high efficiency dust collection system and its associated costs.

The secondary cooler is in the form of a panel bed cooler which includes a thin bed of material with cooling gas flowing crosscurrent to the material flow. This thin bed of material requires only a low pressure fan to draw cooling gas across the material with consequent reduction in energy costs. In a preferred embodiment there is combined crosscurrent and countercurrent gas flow in the secondary cooler to achieve the advantage low pressure requirements of the crosscurrent gas flow and cooling ability of the countercurrent gas flow. Because the material moves through the secondary cooler by gravity, energy consumption is further reduced by the absence of a mechanical means for moving material thrugh the secondary cooler.

It is intended that the foregoing be a description of a preferred embodiment and that the invention be limited solely by that which is within the scope of the appended claim.

I claim:

1. A two stage cooler for cooling hot material discharged from a furnace comprising:

A first cooling apparatus for receiving hot material from a furnace including means for moving the material therethrough, means for passing a cooling gas in direct heat exchange contact with the material as it moves through the first cooling apparatus whereby the material is cooled and the cooling gas is heated, and means for conducting at least a portion of the thus heated cooling gas to the furnace;

a second cooling apparatus including a casing having end walls and sides defining a material shaft, an inlet for receiving material from the first cooling apparatus and an outlet for cooled material; said sides each being formed to define a plurality of gas passageways spaced apart along the sides of the material shaft between the inlet and the outlet; means for passing cooling gas from one side of the material shaft through the gas passageways therein, through the material in the material shaft for direct heat exchange contact with the material therein for further cooling the materials.

the material shaft of the second cooling apparatus being dimensioned so that at least some of the cooling gas passes through the other side of the material shaft substantially perpendicular to the flow of material from the inlet to the outlet; and the means for passing gas through the side is positioned with respect to the inlet for receiving material from the first cooling apparatus so that at least some of the gas flows through said one side and flows through the material to the material inlet, counter current to the flow of material through the material shaft and directly through the first cooler apparatus for supply to the furnace.

2. A two stage cooler for hot material according to claim 1 further comprising means for conducting at least some of the gas that has passed through the material shaft of the second cooling apparatus to the means for passing cooling gas in direct heat exchange contract with the material in the first cooling apparatus.

3. A two stage cooler for hot particulate material according to claim 1 wherein the material shaft of the second cooler is vertically oriented with the inlet in its upper part and the outlet in its lower part, a portion of the said one side of the material shaft being open to atmosphere to permit ambient air to be drawn into the second cooler for countercurrent passage through a portion of the material in the material shaft.

4. A two stage cooler according to claim 1 wherein said means for passing gas through one of the sides of the material shaft includes a pair of conduit means, each flow connected to the other side of the material shaft for recirculating to said one side at least some of the gas which has passed through the material shaft and at least a portion of said one side is open to atmosphere to permit ambient air to be drawn into a second cooler.

5. A two stage cooler according to claim 4 wherein an air to air heat exchanger is flow connected to one of said conduit means for cooling some of the gas which is recirculated.

6. A two stage cooler according to claim 1 further comprising screen means positioned between said first and second cooler means for dividing material discharged from the first cooler into a coarse fraction and a fine fraction, means for directing the fine fraction to said second cooling apparatus and means for directing the coarse fraction to a third cooling apparatus including means for supplying cooling gas for flow substantially countercurrent to the flow of material to be cooled.

7. A two stage cooler according to claim 6 further comprising breaker means positioned between said first and second cooler adjacent said screen.

8. A two stage cooler according to claim 1 wherein said first cooling apparatus is an attached tube cooler.

9. A two stage cooler according to claim 1 wherein said first cooling apparatus is a reciprocating grate cooler and said gas passageways in said second cooler are substantially horizontal.

10. A two stage cooler for cooling hot material according to claim 1 further comprising conduit means for conducting at least some of the gas that has passed in direct heat exchange contact with material in the first cooling apparatus to the means for passing cooling gas in direct heat exchange contact with the material in the first cooling apparatus.

11. A two stage cooler for cooling hot material according to claim 10 wherein conduit means flow connects the gas outlet of the second cooling apparatus to the conduit means for conducting some of the gas from the first cooling apparatus to the means for passing cooling gas in direct heat exchange contact with the material and said conduit is flow connected to the means for passing cooling gas from one side of the material shaft.

12. A two stage cooler for cooling hot material according to claim 11 further comprising heat exchanger means mounted in said conduit for reducing the temperature of gas therein.

* * * * *